United States Patent [19]

Italiaander et al.

[11] 4,194,434

[45] Mar. 25, 1980

[54] DEVICE FOR CONTROLLING A LONGITUDINALLY MOVABLE DRIVING MEANS

[75] Inventors: Albertus Italiaander, Uitgeest; Arie Kruk, Akersloot; Willem G. Nat, Ijmuiden; Nicolaas M. J. Rees, Bloemendaal, all of Netherlands

[73] Assignee: Hoogovens Ijmuiden, B.V., Ijmuiden, Netherlands

[21] Appl. No.: 765,240

[22] Filed: Feb. 17, 1977

[51] Int. Cl.[2] ..... F15B 13/16; F01B 25/04

[52] U.S. Cl. ..... 91/20; 91/29; 91/361; 91/448

[58] Field of Search ..... 91/275, 361, 363 R, 91/363 A, 390, 20, 29; 340/1 R

[56] References Cited

U.S. PATENT DOCUMENTS

| | | | |
|---|---|---|---|
| 2,755,966 | 7/1956 | Lindars | 91/275 |
| 3,365,624 | 1/1968 | Komendera | 91/275 |
| 3,521,535 | 7/1970 | Oelrich | 91/47 |
| 3,522,764 | 8/1970 | Biber et al. | 340/1 R |

*Primary Examiner*—Paul E. Maslousky

*Attorney, Agent, or Firm*—Stevens, Davis, Miller & Mosher

[57] ABSTRACT

A device for controlling both the displacement of, and the transmittal of force by, a longitudinally movable driving apparatus comprising a piston rod which is hydraulically movable inside a cylinder, an emitter and receiver for ultrasonic waves, which are transmitted between a movable and a fixed part of the driving apparatus, a logic circuit and a controllable source of force, said receiver being electronically connected to said controllable source of force via said logic circuit.

6 Claims, 3 Drawing Figures

FIG. 1
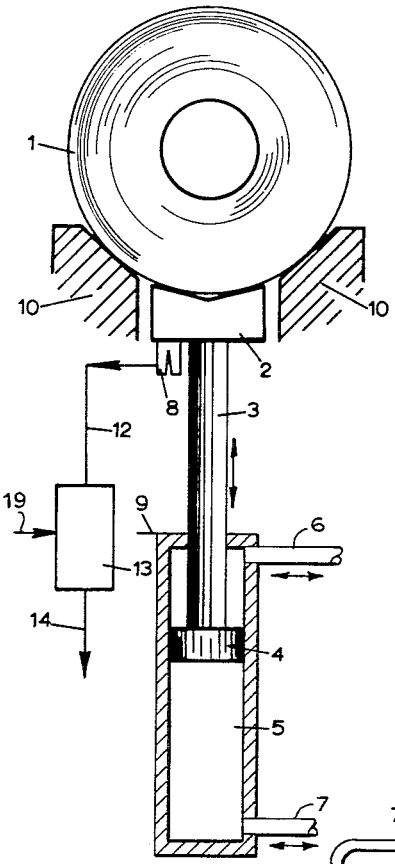
FIG. 2
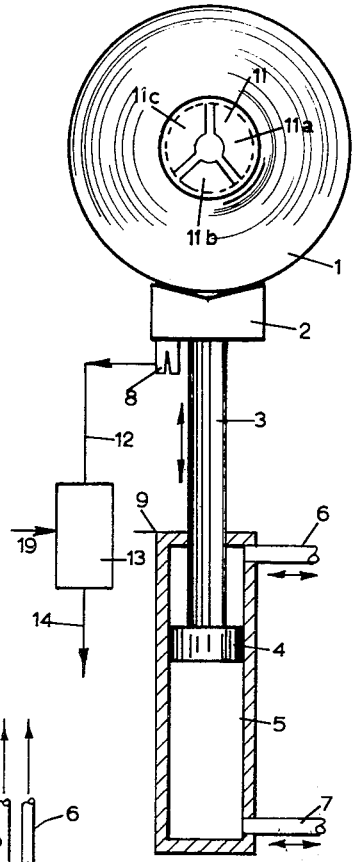
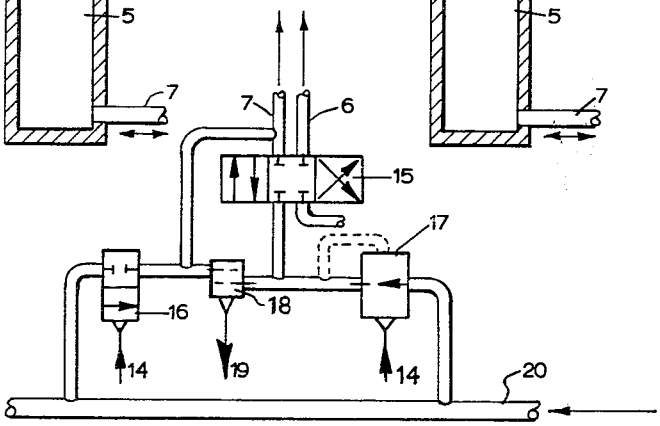
FIG. 3

DEVICE FOR CONTROLLING A LONGITUDINALLY MOVABLE DRIVING MEANS

The invention relates to a device for controlling both the displacement of, and the transmittal of force by, a longitudinally movable driving means, especially one of the type comprising a piston rod which is hydraulically movable inside a cylinder. In the following description the invention will mainly be described on the basis of a lifting device for coils of rolled steel and similar objects, in which the lifting device mainly consists of a hydraulically driven piston rod carrying at its end a saddle upon which the coil may be supported. Nevertheless the invention is not at all restricted to this application of a driving means, but may be applied in many different ways for such applications where a delicate interaction is required between a linear displacement and a controllable transmission of force. The movement also need not be generated by a hydraulic cylinder, but it may also be feasible to apply the invention in the use of a pneumatic cylinder, or of a linear movement which is derived by means of a transmission mechanism from an electrical motor drive, or similar mechanisms.

A typical application of the invention may be found in the positioning and removing of coils of cold or hot rolled steel on, or from, a coiling spindle.

This operation is to be performed, in mills and other works handling coiled steel strips, each time that the strip-shaped material is to be wound or unwound. Although use is frequently made of hydraulic lifting devices for positioning the coil opposite the coiling spindle, or for moving it away therefrom, it has been found nevertheless that difficulties may occur. These difficulties may be caused by dimensional deviations of the coil, deviations in weight, deformed ends of the strip, and the like. All this may have the result that the force with which the hydraulic lifting device is moved towards the coil becomes too great, thus resulting in damage to the coiling spindle. It may also happen that the adjustment of the position of the hydraulic lifting device is insufficiently accurate, this leading to particular difficulties in removing the coil or in the positioning of the coil upon the spindle. Particularly this may happen if a bent end of the strip has first to be deformed by the saddle.

The invention aims to provide driving means, especially of the type comprising a hydraulically movable piston rod, in which both the displacement of said driving means and the transmittal force thereby may be controlled with great accuracy.

The invention consists in that said device comprises means for emitting and receiving ultrasonic waves, which are transmitted between a movable and a fixed part of the driving means, and in that the receiver is electronically connected to a controllable source of force via a logic circuit.

It is remarked that it might be obvious to provide the device with a signal-generator for the logic circuit which creates a signal completely by electrical or electronic means, for instance by employing potentiometers which are operated by the driving means or by using pick-ups of the induction or capacity type. It was found, however, that in the operational conditions in a steel mill such more obvious solutions are insufficiently safe in operation. It should be remembered that an inaccuracy in the signal generator may give rise to extremely serious damage to the coiling spindle, and consequently may lead to serious difficulties in operation and to loss of production. It was found that by applying ultrasonic waves a particularly reliable solution may be obtained, which may operate with high accuracy without interruption. Particularly the invention also relates to such a device in which the logic circuit generates control signals in dependence both on the state of movement or stand-still of the driving means, and on the position thereof. As will be known, ultrasonic signal generators are particularly suitable for generating signals which may be transformed to this type of control signal. The length of the path travelled by the ultrasonic waves, and the variation of said length, are thereby representative quantities for the position and for the state of movement of the driving means. In a possible embodiment of the device according to the invention, the emitter and the receiver are connected to different elements of the driving means which are movable with respect to each other. For instance in the case of a lifting device for steel coils, as explained above, the emitter may be connected to the saddle while the receiver is connected to a fixed cylinder, or the other way round. Also, however, a preferred embodiment of the device according to the invention is possible, in which the emitter and the receiver are connected as one unit to one of relatively movable elements of the driving means and are opposed to a reflecting surface which is connected to the other of said elements. In that case the combination emitter-receiver may be connected to the saddle, with the reflecting surface being connected to the cylinder, or vice versa. In this embodiment the wiring may of course be simpler. Dependent on the application of the driving means, different functions may be included into the logic circuit in a manner which need not create particular problems to one knowledgeable in the art. For instance, for the lifting of a coiled steel strip in order to position it upon a coiling spindle, the logic circuit may according to the invention be made so that it allows movement of the driving means with a small force into a position in which a counteracting force exceeds the driving force, whereupon the driving force is increased and stabilised at a value at which the counteracting force is balanced, and the driving means is additionally moved over an adjustable length of path.

In this way for instance a roll may be lifted from a fixed base into a position opposite the coiling spindle. In that case, a piston with the saddle fixed to it first moves quickly upwardly against the stationary roll, the weight of which is greater than the force with which the piston is pushed upwardly. The arrest of the saddle against the roll is registered by the receiver for ultrasonic waves, as also the momentary position of the saddle against the roll. Then, the logic circuit increases the fluid pressure in the hydraulic cylinder until the saddle with the roll starts moving again. The receiver then registers a state of movement, whereupon the fluid pressure is stabilised by the logic circuit. Optionally the logic circuit may also incorporate a fixed length of path to be covered after the start of the movement. Also a certain excess of fluid pressure may be built in, which may be necessary to bend bent strip ends if present, or more generally to apply a roll correction.

It is also possible to provide a function in the logic circuit which allows movement of the driving means with a small force into a starting position in which it meets a resisting force, whereafter upon the occurrence of a counteracting force which exceeds the driving force, the driving force is increased up to a value which balances the counteracting force after the driving means has moved back into the starting position. This function is of particular importance if a roll is taken off a winding spindle. In unloading the spindle, it is the intention that the coil gets completely free from the spindle and rests upon the saddle. If however, this saddle is moved against the coil and is held against the coil in a state of balance by a force which is smaller than the weight of the coil, than upon unloading of the spindle the coil with the saddle together will have a tendency to move downwardly. The state of movement which is then registered by the receiver is then translated into a signal which increases the fluid pressure until the saddle has gone back to the same position it was prior to unloading the coiling spindle.

It has already been remarked that the invention may in principle be applied similarly to driving means different from those of the type comprising hydraulic cylinders. If however, use is made of a piston rod movable inside a cylinder, preference is to be given to a construction in which an actuating slide, and further a reduction valve and a filling valve are provided between a high pressure fluid system and the cylinder, said valves being electronically adjusted by the logic circuit with the aid of the measurement of a differential pressure.

Although as has already been remarked, the invention may be applied to all such situations in which a controllable adjustment of the driving force applied to a load is required, in combination with a desired displacement, good results have more especially been obtained when applying the invention to lifting devices for hot and cold rolled coils of steel strip. In that case the piston rod should preferably be provided with a saddle which is adapted to carry such coils of steel strip.

The principle of the invention will be demonstrated referring to some figures which by way of example demonstrate its application to a hydraulic lifting device for a coil of rolled steel.

FIG. 1 schematically shows a situation with one possible application of the invention.

FIG. 2 demonstrates a different possible application of the invention.

FIG. 3 is a schematic diagram of the possible control system for a hydraulic source of force.

In FIGS. 1 and 2 reference number 1 shows a coil of hot-rolled steel-strip. Against this coil fits a saddle 2 which is connected to the end of a piston rod 3. The piston rod 3 itself may be moved in the indicated direction if fluid is admitted at one side of the piston 4, inside cylinder 5, by either conduit 6 or 7.

Mounted on the saddle 2 is a combined emitter-receiver 8 for ultrasonic waves, which is aimed parallel to the piston rod towards a fixed reflector plate 9. The signal from the receiver is fed via 12 to a logic circuit 13, the output signal 14 of which serves for controlling the displacement of fluid via conduits 6 and 7, and the pressure of the liquid. A differential pressure signal 19 in the system is also fed to the circuit 13.

FIG. 1 shows a situation in which the coil 1 is lying on a fixed frame 10 and is to be lifted therefrom by the saddle 2 over a predetermined height.

In FIG. 2 a situation is shown in which the coil 1 is situated on a coiling spindle 11, and is to be transferred onto the saddle 2 after the coiling spindle 11 has come free from the coil by contraction of the expandable segments 11*a* to *c* (the dotted position).

Signal 14 generated by the logic circuit 13, is fed to the control system as shown in FIG. 3. This comprises an actuating slide 15 which connects to the supply conduits 6 and 7 to both sides of piston 4 in cylinder 5. Also a filling valve 16, a reduction valve 17, and a differential pressure meter 18 are provided. Both the filling valve 16 and the reduction valve 17 are set by means of signals 14 from the logic circuit 13.

In the situation of FIG. 1 the saddle 2 is first moved by hand control against coil 1 with a minimum of pressure, which is sufficiently low that the saddle just comes to a halt against the coil. The arrest of the saddle against coil 1 is registered by receiver 8, which also notes the position of rest of the saddle. The minimum pressure activates the logic circuit. After this signal has been fed to 13 and after a programmed period of standstill of the saddle, the logic circuit first of all (see FIG. 3) eliminates the possibility of manual operation of slide 15 and brings this slide into its middle position thus shutting off the cylinder from the pressure system. Thereupon the filling valve is opened allowing fluid to flow into cylinder 5 through conduit 7 which results in piston 4 moving upwardly. Once the upward movement is detected by receiver 8 a signal is transmitted to logic circuit 13 from receiver 8. The logic circuit then shuts valve 16 and the upward movement of piston 4 stops. With valve 15 being closed with respect to conduit 7 the pressure in conduit 7 is greater than in the reduction valve 17 wich pressure corresponds to the weight of the coil. This difference in pressure between conduit 7 and valve 17 is registered by meter 18 which sends a signal 19 to the logic circuit 13 which in turn signals valve 17 to permit an increase in pressure upstream of valve 15 until the pressure upstream and downstream of valve 15 through conduit 7 is the same. The valve 15 relating to conduit 7 is then opened by the logic circuit 13. The logic circuit 13 then permits valve 17 to increase the pressure sufficiently to just free the saddle and metal strip from the fixed frame 10. The logic circuit 13 permits the over pressure in valve 17. After stabilising the reduction valve 17, the possibility of manual operation of the slide 15 is reinstated. The logic circuit 13 is thereupon put out of function, and is brought to its starting position.

In FIG. 2, there is shown the situation in which coil 1 is on coiling spindle 11 and is to be transferred to the saddle 2.

In this situation first of all saddle 2 is moved by manual control against coil 1 with a minimum pressure, which causes the saddle to come to a standstill against the coil, and the upward force on the coiling spindle does not exceed a maximum admissible value at a minimal coil weight.

The minimum pressure activates the logic circuit 13. The halt of the saddle 2 is registered by the emitter-receiver 8 which also registers the instantaneous position of the saddle in the logic circuit 13. If thereupon the segments of the contractable spindle 11 are contracted, the coil will rest to a greater or lesser degree upon the saddle. Because of the low pressure and the compressability of the hydraulic medium the coil 1 may press down the saddle 2. However, it is conceivable that a coil of small weight, because of a geometric deformation, remains at rest upon the contracted spindle. Notwithstanding the position of the coil, the filling valve 16 is controlled by the contraction of the spindle. Oil is supplied at sufficient pressure to cylinder 5 to lift the coil.

After a programmed period of standstill of the saddle, the manual operation of the slide 15 is shut off in a similar way to that described in FIG. 1 and the cylinder 5 is thus shut off from the pressure system.

The logic circuit is designed so that after lifting by a height less than the play between the coil and the contracted spindle segments, the filling valve is shut again. Simultaneously the reduction valve is activated. By means of the differential pressure measurement 18 the pressure of the reduction valve is compared with the pressure in the supply conduit 7 to cylinder 5 in a similar way to that described in FIG. 1, the pressure in supply conduit 7 corresponding to the weight of the coil. An adjustable over-pressure is fed to the reduction valve on top of the pressure in the supply conduit of the cylinders. After the pressures on both sides of the reduction valve are equilibrated, the manual operation is again activated. The logic circuit is put out of function and brought to the starting position. The coil may now, if desired, be manipulated on the coiling spindle with an extra force, by means of the adjustable over-pressure on the reduction valve. Thereupon the coil may be discharged from the coiling spindle without any problems.

Although present in the system, all those safety stops and other operational conditions which are obvious to one knowledgeable in the art have not been indicated in the Figures.

We claim:

1. A device for controlling both the displacement of, and the transmittal of force by, a longitudinally movable driving means, comprising a piston rod which is hydraulically movable inside a cylinder, means for emitting and receiving ultrasonic waves, which are transmitted between a movable and a fixed part of the driving means, a logic circuit and a controllable source of force, said means for receiving being electronically connected to said controllable source of force via said logic circuit, said logic circuit allowing movement of the driving means with a small force into a position in which a counteracting force exceeds the driving force, whereupon the driving force is increased and stabilised at a value at which the counteracting force is compensated and the driving means is additionally moved over an adjustable length of path.

2. The device according to claim 1 wherein the emitter and the receiver are connected as one unit to one of the relatively movable elements of the driving means, and are opposed to a reflecting surface which is connected to the other of said elements.

3. The device according to claim 1 wherein the driving means includes a saddle for carrying rolls of steel strip.

4. A device for controlling both the displacement of, and the transmittal of force by, a longitudinally movable driving means, comprising a piston rod which is hydraulically movable inside a cylinder, means for emitting and receiving ultrasonic waves, which are transmitted between a movable and a fixed part of the driving means, a logic circuit and a controllable source of force, said means for receiving being electronically connected to said controllable source of force via said logic circuit, said logic circuit allowing movement of the driving means with a small force into a starting position in which it meets a resisting force, whereafter upon the occurrence of a counteracting force which exceeds the driving force the driving force is increased up to a value which balances the counteracting force with the driving means moving back into the starting position.

5. A device for controlling both the displacement of, and the transmittal of force by, a longitudinally movable driving means, comprising a piston rod which is hydraulically movable inside a cylinder, means for emitting and receiving ultrasonic waves, which are transmitted between a movable and a fixed part of the driving means, a logic circuit and a controllable source of force, said means for receiving being electronically connected to said controllable source of force via said logic circuit, said controllable source of force including an actuating slide, reduction valve and filling valve, said reduction valve and filling valve being provided between a high pressure liquid system and the cylinder, said valves being electronically adjusted by the logic circuit with the aid of the measurement of a differential pressure.

6. The device according to claim 5 wherein the logic circuit generates control-signals in dependence both on the state of movement or standstill of the driving means, and on the position thereof.

* * * * *